US010240345B2

(12) United States Patent
Kelly

(10) Patent No.: US 10,240,345 B2
(45) Date of Patent: Mar. 26, 2019

(54) ASPHALT EMULSION APPLICATION DEVICE

(71) Applicant: Rufus Kelly, Shreveport, LA (US)

(72) Inventor: Rufus Kelly, Shreveport, LA (US)

( * ) Notice: Subject to any disclaimer, the term of this patent is extended or adjusted under 35 U.S.C. 154(b) by 28 days.

(21) Appl. No.: 15/474,239

(22) Filed: Mar. 30, 2017

(65) Prior Publication Data

US 2018/0283010 A1 Oct. 4, 2018

(51) Int. Cl.

| | |
|---|---|
| ***E04D 15/00*** | (2006.01) |
| ***B05C 17/10*** | (2006.01) |
| *B05C 17/00* | (2006.01) |

(52) U.S. Cl.

CPC ..... *E04D 15/00* (2013.01); *B05C 17/10* (2013.01); *B05C 17/00* (2013.01)

(58) Field of Classification Search

CPC ..... B05C 17/10; B05C 17/00; E04D 15/00; E04D 15/07; E04F 21/00

USPC ..... 15/245.1, 235.4; D8/45; D32/49

See application file for complete search history.

(56) References Cited

U.S. PATENT DOCUMENTS

| | | | | |
|---|---|---|---|---|
| 2,008,952 | A * | 7/1935 | Gach | E04D 15/04 15/245.1 |
| 2,081,735 | A * | 5/1937 | Caronia | E04D 15/07 15/245.1 |
| 2,806,240 | A | 9/1957 | Cottar | |
| 2,824,330 | A | 2/1958 | Williams | |
| 2,913,753 | A | 11/1959 | Peterson | |
| 5,778,482 | A | 7/1998 | Sbrigato | |
| 6,308,370 | B1 | 10/2001 | Southby | |
| 6,662,406 | B2 * | 12/2003 | Shonfeld | A01B 1/00 16/430 |
| D587,079 | S | 2/2009 | Alred | |

* cited by examiner

*Primary Examiner* — Laura C Guidotti

(57) ABSTRACT

An asphalt emulsion application device for roofing cement application includes a rod, a first plate and a pair of second plates. The first plate has a first edge that is coupled to a first end of the rod. Each second plate is coupled to and extends transversely from a respective opposing side edge of the first plate. The rod is configured to be grasped in a hand of a user. The first plate is positioned on the rod and the second plates are positioned on the first plate such that the first plate and the second plates are configured to position of an emulsion, such as roofing cement. The rod is positioned to motivate the emulsion to a desired location. The rod also is positioned to motivate the first plate and the second plate to spread the emulsion.

11 Claims, 3 Drawing Sheets

ASPHALT EMULSION APPLICATION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to application devices and more particularly pertains to a new application device for roofing cement application.

BRIEF SUMMARY OF THE INVENTION

An embodiment of the disclosure meets the needs presented above by generally comprising a rod, a first plate and a pair of second plates. The first plate has a first edge that is coupled to a first end of the rod. Each second plate is coupled to and extends transversely from a respective opposing side edge of the first plate. The rod is configured to be grasped in a hand of a user. The first plate is positioned on the rod and the second plates are positioned on the first plate such that the first plate and the second plates are configured to position of an emulsion, such as roofing cement. The rod is positioned to motivate the emulsion to a desired location. The rod also is positioned to motivate the first plate and the second plate to spread the emulsion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
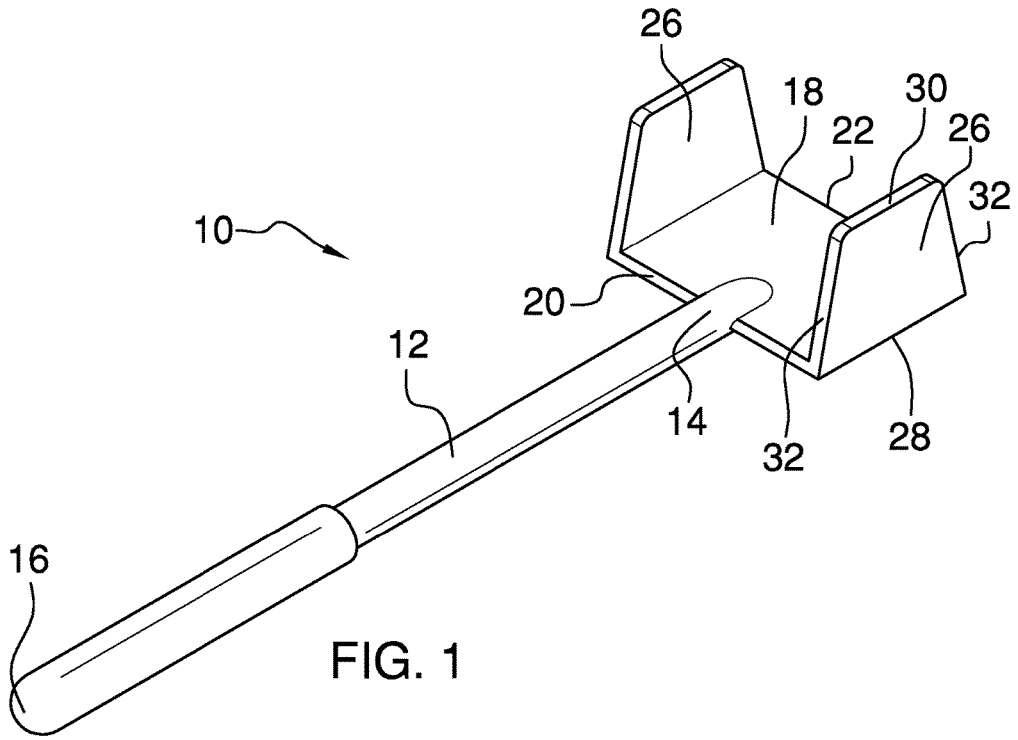
FIG. 1 is an isometric perspective view of an asphalt emulsion application device according to an embodiment of the disclosure.
Figure 2:
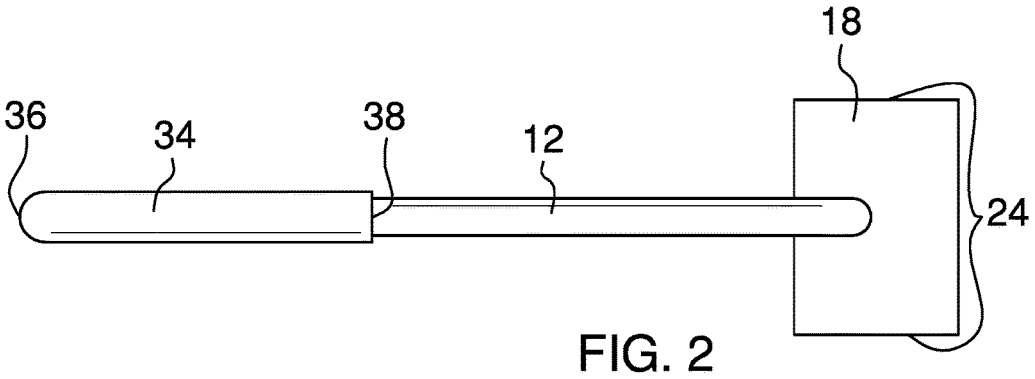
FIG. 2 is a bottom view of an embodiment of the disclosure.
Figure 3:
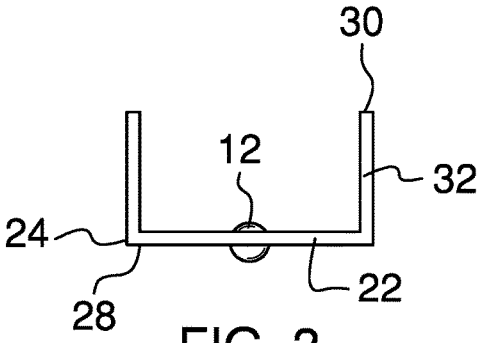
FIG. 3 is an end view of an embodiment of the disclosure.
Figure 4:
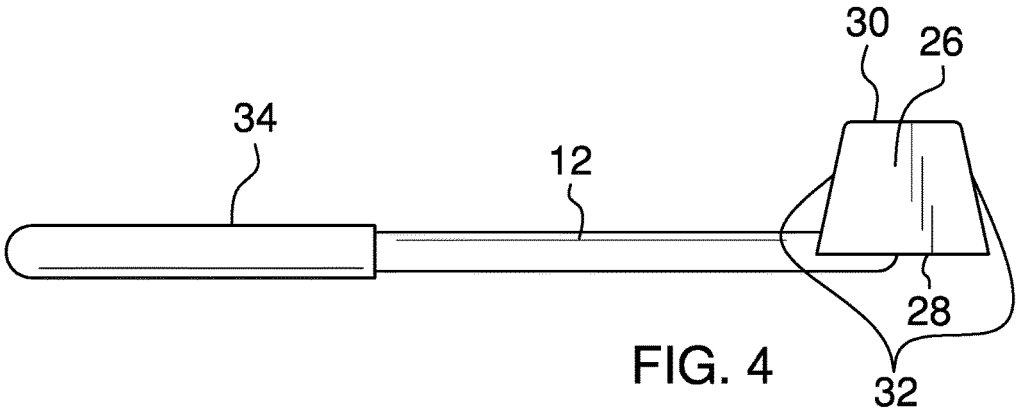
FIG. 4 is a side view of an embodiment of the disclosure.
Figure 5:
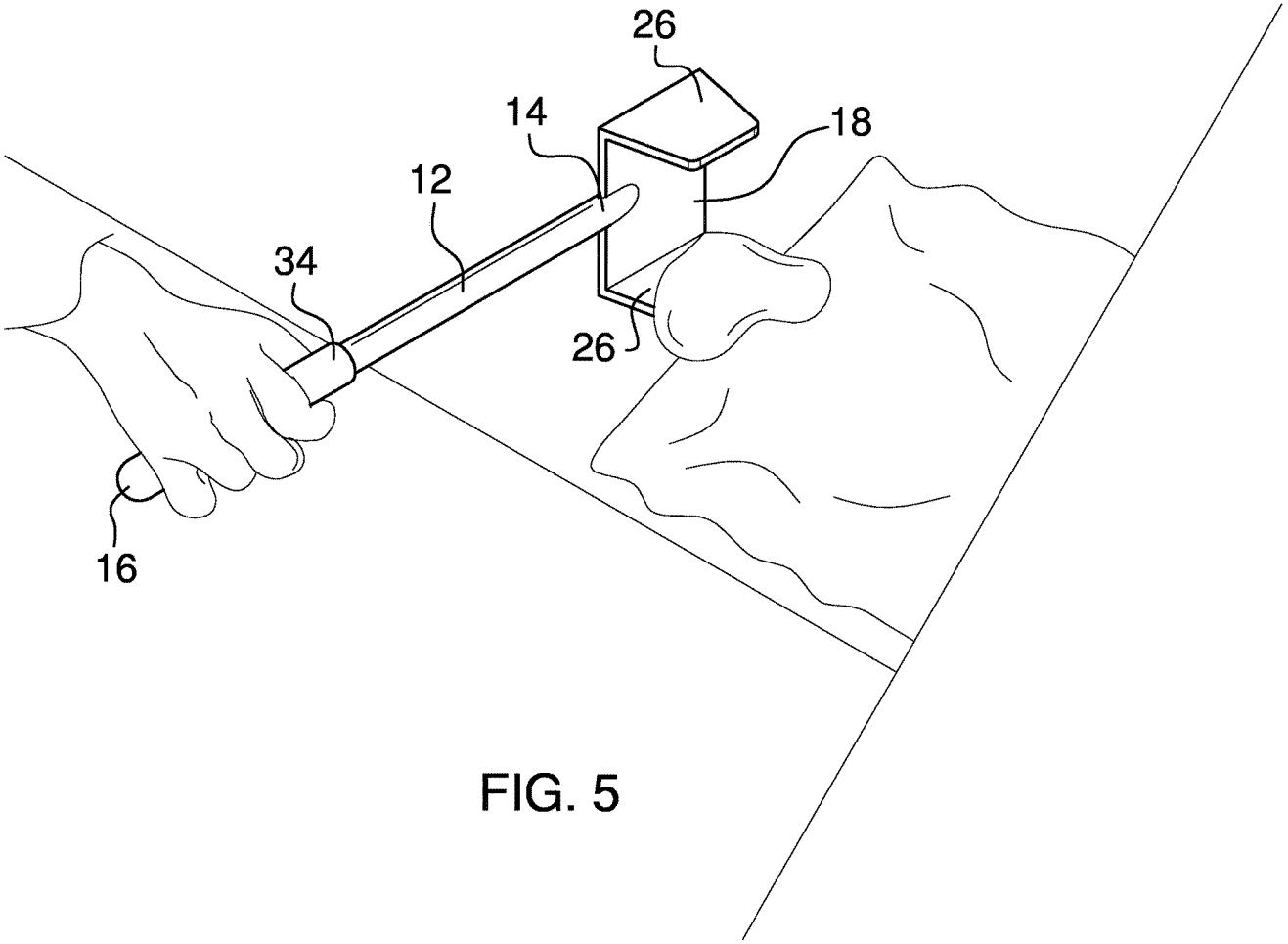
FIG. 5 is an in-use view of an embodiment of the disclosure.

With reference now to the drawings, and in particular to FIGS. 1 through 5 thereof, a new application device embodying the principles and concepts of an embodiment of the disclosure and generally designated by the reference numeral 10 will be described.

As best illustrated in FIGS. 1 through 5, the asphalt emulsion application device 10 generally comprises a rod 12. In one embodiment, the rod 12 is substantially circularly shaped when viewed longitudinally. In another embodiment, the rod 12 comprises metal. In yet another embodiment, a first end 14 and a second end 16 of the rod 12 are separated by from 14.0 to 26.0 centimeters. In still yet another embodiment, the first end 14 and the second end 16 of the rod 12 are separated by from 17.0 to 23.0 centimeters. In still yet another embodiment, the first end 14 and the second end 16 of the rod 12 are separated by 20.32 centimeters.

A first plate 18 has a first edge 20 that is coupled to the first end 14 of the rod 12. In one embodiment, the first plate 18 is substantially rectangularly shaped. In another embodiment, the first plate 18 comprises metal. In yet another embodiment, the first edge 20 and a second edge 22 of the first plate 18 are separated by from 5.0 to 8.0 centimeters and opposing side edges 24 of the first plate 18 are separated by from 4.0 to 6.0 centimeters. In still yet another embodiment, the first edge 20 and the second edge 22 of the first plate 18 are separated by from 6.0 to 7.0 centimeters and the opposing side edges 24 of the first plate 18 are separated by from 4.5 to 5.5 centimeters. In still yet another embodiment, the first edge 20 and the second edge 22 of the first plate 18 are separated by 6.35 centimeters and the opposing side edges 24 of the first plate 18 are separated by 5.08 centimeters.

Each of a pair of second plates 26 is coupled to and extends transversely from a respective opposing side edge 24 of the first plate 18. In one embodiment, the second plates 26 comprise metal. Each second plate 26 comprises a long base 28, a short base 30, and opposing sides 32. The long base 28 is coupled to the respective opposing side edge 24 of the first plate 18. The opposing sides 32 extend transversely between the long base 28 and the short base 30. The second plate 26 is substantially isosceles trapezoidally shaped. In another embodiment, the long base 28 and the short base 30 are separated by from 4.0 to 6.0 centimeters. In yet another embodiment, the long base 28 and the short base 30 are separated by from 4.5 to 5.5 centimeters. In still yet another embodiment, the long base 28 and the short base 30 are separated by 5.08 centimeters.

A handle 34 is coupled to and positioned on the rod 12. The handle 34 is configured to be grasped in a hand of a user. The handle 34 extends from a second end 16 of the rod 12 toward the first end 14. In one embodiment, the handle 34 is tubular. The handle 34 has a first endpoint 36 and a second endpoint 38. The second endpoint 38 is open. The second endpoint 38 is positioned to insert the second end 16 of the rod 12 into the handle 34, such that the handle 34 is coupled to the rod 12. In another embodiment, the first endpoint 36 is rounded. In yet another embodiment, the handle 34 comprises plastic.

In use, the handle 34 is configured to be grasp in the hand of the user. The first plate 18 is positioned on the rod 12 and the second plates 26 are positioned on the first plate 18. The first plate 18 and the second plates 26 are configured to position an emulsion, such as roofing cement. The rod 12 is positioned to motivate the emulsion to a desired location. The rod 12 also is positioned to motivate the first plate 18 and the second plate 26 to spread the emulsion.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. Asphalt emulsion application device comprising:

a rod, a first plate having a first edge coupled to a first end of said rod, said first plate being substantially rectangularly shaped;

a pair of second plates, each said second plate being coupled to and extending transversely from a respective opposing side edge of said first plate, each said second plate comprising a long base, a short base, and opposing sides, said long base being coupled to said respective said opposing side edge of said first plate, said opposing sides extending transversely between said long base and said short base such that said second plate is substantially isosceles trapezoidally shaped;

wherein said rod is configured for grasping in a hand of a user such that said first plate is positioned on said rod and said second plates are positioned on said first plate such that said first plate and said second plates are configured for positioning of an emulsion, such as roofing cement, wherein said rod is positioned to motivate the emulsion to a desired location, and wherein rod is positioned to motivate said first plate and said second plate to spread the emulsion;

a first end and a second end of said rod being separated by from 14.0 to 26.0 centimeters;

said first edge and a second edge of said first plate being separated by from 5.0 to 8.0 centimeters;

said opposing side edges of said first plate being separated by from 4.0 to 6.0 centimeters; and said long base and said short base being separated by from 4.0 to 6.0 centimeters.

2. The device of claim 1, further including said rod being substantially circularly shaped when viewed longitudinally.

3. The device of claim 1, further including said rod, said first plate and said second plates comprising metal.

4. The device of claim 1, further comprising:

said first end and said second end of said rod being separated by from 17.0 to 23.0 centimeters;

said first edge and said second edge of said first plate being separated by from 6.0 to 7.0 centimeters;

said opposing side edges of said first plate being separated by from 4.5 to 5.5 centimeters; and said long base and said short base being separated by from 4.5 to 5.5 centimeters.

5. The device of claim 4, further comprising:

said first end and said second end of said rod being separated by 20.32 centimeters said first edge and said second edge of said first plate being separated by 6.35 centimeter;

said opposing side edges of said first plate being separated by 5.08 centimeters; and said long base and said short base being separated by 5.08 centimeters.

6. The device of claim 1, further including a handle coupled to and positioned on said rod, wherein said handle is positioned on said rod such that said handle is configured for grasping in the hand of the user.

7. The device of claim 6, further including said handle extending from a second end of said rod toward said first end.

8. The device of claim 7, further including said handle being tubular, said handle having a first endpoint and a second endpoint, said second endpoint being open such that said second endpoint is positioned for insertion of said second end of said rod into said handle such that said handle is coupled to said rod.

9. The device of claim 8, further including said first endpoint being rounded.

10. The device of claim 6, further including said handle comprising plastic.

11. Asphalt emulsion application device comprising:

a rod, said rod being substantially circularly shaped when viewed longitudinally, said rod comprising metal, a first end and a second end of said rod being separated by from 14.0 to 26.0 centimeters, said first end and said second end of said rod being separated by from 17.0 to 23.0 centimeters, said first end and said second end of said rod being separated by 20.32 centimeters;

a first plate having a first edge coupled to a first end of said rod, said first plate being substantially rectangularly shaped, said first plate comprising metal, said first edge and a second edge of said first plate being separated by from 5.0 to 8.0 centimeters, opposing side edges of said first plate being separated by from 4.0 to 6.0 centimeters, said first edge and said second edge of said first plate being separated by from 6.0 to 7.0 centimeters, said opposing side edges of said first plate being separated by from 4.5 to 5.5 centimeters, said first edge and said second edge of said first plate being separated by 6.35 centimeter, said opposing side edges of said first plate being separated by 5.08 centimeters;

a pair of second plates, each said second plate being coupled to and extending transversely from a respective said opposing side edge of said first plate, said second plates comprising metal, each said second plate comprising a long base, a short base, and opposing sides, said long base being coupled to said respective said opposing side edge of said first plate, said opposing sides extending transversely between said long base and said short base such that said second plate is substantially isosceles trapezoidally shaped, said long base and said short base being separated by from 4.0 to 6.0 centimeters, said long base and said short base being separated by from 4.5 to 5.5 centimeters, said long base and said short base being separated by 5.08 centimeters;

a handle coupled to and positioned on said rod, wherein said handle is positioned on said rod such that said handle is configured for grasping in a hand of a user, said handle extending from a second end of said rod toward said first end, said handle being tubular, said handle having a first endpoint and a second endpoint, said second endpoint being open such that said second endpoint is positioned for insertion of said second end of said rod into said handle such that said handle is coupled to said rod, said first endpoint being rounded, said handle comprising plastic; and wherein said handle is positioned on said rod such that said handle is configured for grasping in a hand of a user, such that said first plate is positioned on said rod and said second plates are positioned on said first plate such that said first plate and said second plates are configured for positioning of an emulsion, such as roofing cement, wherein said rod is positioned to motivate the emulsion to a desired location, and wherein rod is positioned to motivate said first plate and said second plate to spread the emulsion.

* * * * *